United States Patent [19]

Sluyterman

[11] Patent Number: 4,939,414

[45] Date of Patent: Jul. 3, 1990

[54] COLOR CATHODE RAY TUBE WITH MAGNETIC FIELD CONDUCTING PLATES WITHIN ENVELOPE

[75] Inventor: Albertus A. S. Sluyterman, Eindhoven, Netherlands

[73] Assignee: U.S. Philips Corporation, New York, N.Y.

[21] Appl. No.: 162,528

[22] Filed: Mar. 1, 1988

[30] Foreign Application Priority Data

Mar. 25, 1987 [GB] United Kingdom ..... 8707171

[51] Int. Cl.[5] ..... H01J 29/50; H01J 29/56

[52] U.S. Cl. ..... 313/431; 313/160; 313/414; 335/211

[58] Field of Search ..... 313/431, 414, 479, 160; 335/211, 212

[56] References Cited

U.S. PATENT DOCUMENTS

| | | | |
|---|---|---|---|
| 2,410,054 | 10/1946 | Fremlin et al. | 313/155 X |
| 2,411,155 | 11/1946 | Gorn | 313/160 X |
| 3,274,418 | 9/1966 | Crumly | 313/431 |
| 3,505,554 | 4/1970 | Vekshinsky et al. | 313/155 X |
| 3,860,850 | 1/1975 | Takenaka et al. | 313/431 X |
| 4,105,983 | 8/1978 | Barten et al. | 335/212 |
| 4,242,612 | 12/1980 | Heijnemans et al. | 313/421 |
| 4,609,847 | 9/1986 | Ashizaki et al. | 313/431 X |
| 4,656,390 | 4/1987 | Fukuda et al. | 313/409 |

FOREIGN PATENT DOCUMENTS

| | | | |
|---|---|---|---|
| 6762 | 1/1979 | Japan | 313/431 |

*Primary Examiner*—Palmer C. DeMeo

*Attorney, Agent, or Firm*—Brice Faller; Jack E. Haken; Robert J. Kraus

[57] ABSTRACT

An improved picture sensitivity to the magnetic field produced by a field deflection coil (28) for an in-line gun shadow mask display tube is obtained by positioning magnetic field conducting elements (32, 34) within the envelope of the display tube in the central deflection area of the field produced by the field coil (28). By positioning the magnetic field conducting elements (32, 34) inside the envelope, the distances between the elements (32, 34) and the yoke ring (30) and between the elements (32, 34) and the field coil (28) are such that the unnecessary flux is significantly less compared to a known situation in which these elements are located between the line and field coils, thus improving the field deflection sensitivity.

7 Claims, 1 Drawing Sheet.

COLOR CATHODE RAY TUBE WITH MAGNETIC FIELD CONDUCTING PLATES WITHIN ENVELOPE

BACKGROUND OF THE INVENTION

The present invention relates to a color cathode ray tube having in an envelope including a faceplate, a cone and a neck. In line electron beam producing means disposed within the neck produce three electron beams which lie, when undeflected, substantially in a single plane on which plane the longitudinal axis lies, the axis of the central beam, when undeflected, substantially coinciding with the longitudinal axis. A cathodoluminescent screen is provided on the faceplate and a shadowmask lies adjacent to but spaced from, the faceplate. A deflection unit includes a field deflection coil and a line deflection coil. Magnetic field conducting means are arranged such that when the field deflection coil is energized, the magnetic field deflection field produced at the central deflection area is barrel shaped.

U.S. Pat. No. 4,242,612 discloses a deflection unit comprising a line deflection coil which is constituted by two diametrically oppositely arranged coil portions for deflecting an electron beam in a first, horizontal direction, a field deflection coil which is constituted by two diametrically oppositely arranged field coil portions for deflecting an electron beam in a second, vertical direction transverse to the first direction, and magnetic field conducting means comprising two soft-magnetic plates located diametrically opposite to each other between the field and line deflection coils adjacent the center of the field deflection coil. The purpose of these plates is to provide field astigmatism correction by adjusting the magnetic field produced when the deflection unit is energized in such a manner that it is barrel shaped at the central deflection area. In the known deflection coil unit the soft-magnetic plates are located radially outwards of the line deflection coil so that the plates have only a slight influence, if any, on the line deflection magnetic field.

The soft magnetic plates are normally held captive within the thickness of a resin shell inside which the line deflection coil, which may comprise two saddle-type coil portions, is arranged. If the field deflection coil comprises two saddle-type portions then they are mounted externally of the resin shell, rotated 90° relative to the line coil portions, and an annular core member of soft magnetic material, otherwise termed the yoke ring, encloses the field deflection coil. Alternatively if the field deflection coil comprises two toroidally wound coil portions then these are wound on the annular core member of soft magnetic material, which member encloses the resin shell.

While such a deflection unit functions satisfactorily, there is always a requirement by set makers to improve the sensitivity of the deflection unit while minimizing coma, raster and astigmatic effects.

SUMMARY OF THE INVENTION

The magnetic field conducting means, which may comprise curved plates, are provided within the envelope, for example by affixing them to the internal surface of the envelope or attaching each plate to a non-magnetic field conducting member secured to the electron beam producing means. This provides a number of advantages over the known arrangement disclosed in U.S. Pat. No. 4,242,612. The field deflection sensitivity is improved because the distances between the magnetic field conducting elements and the copper of the field deflection coil and between the magnetic field conducting elements and the yoke ring are in each case greater which results in less unnecessary flux between the magnetic field conducting elements and the yoke ring. It is no longer necessary for the resin shell to be of a relatively large thickness because it does not have to accommodate the magnetic field conducting elements. Consequently the shell can be made thinner and the field deflection coil can be slightly smaller and closer to the beams. This means that a further improvement in field deflection sensitivity can be gained. The disposition of the magnetic field conducting means within the envelope, particularly in the neck, makes use of unused space above and below the in-line electron beams and therefore does not require any special modifications of the envelope. These advantages generally outweigh the possible disadvantages of the influence of the field conducting means on the line deflection field.

The axial position of the magnetic field conducting means is determined by the deflection field produced by the field coil. If the magnetic field conducting elements are too close to, or at, the rear (gun) end or the front (screen) end of the frame deflection field then they will affect adversely the coma and raster effects, respectively, without improving the sensitivity and reducing field astigmatism. However in order to be effective the magnetic field conducting elements should be in an axial position where the electron beams have already experienced some deflection, i.e. adjacent to the central deflection area.

BRIEF DESCRIPTION OF THE DRAWING

In the drawings corresponding reference numerals have been used to indicate the same parts.

DETAILED DESCRIPTION OF THE PREFERRED EMBODIMENT

Figure 1:
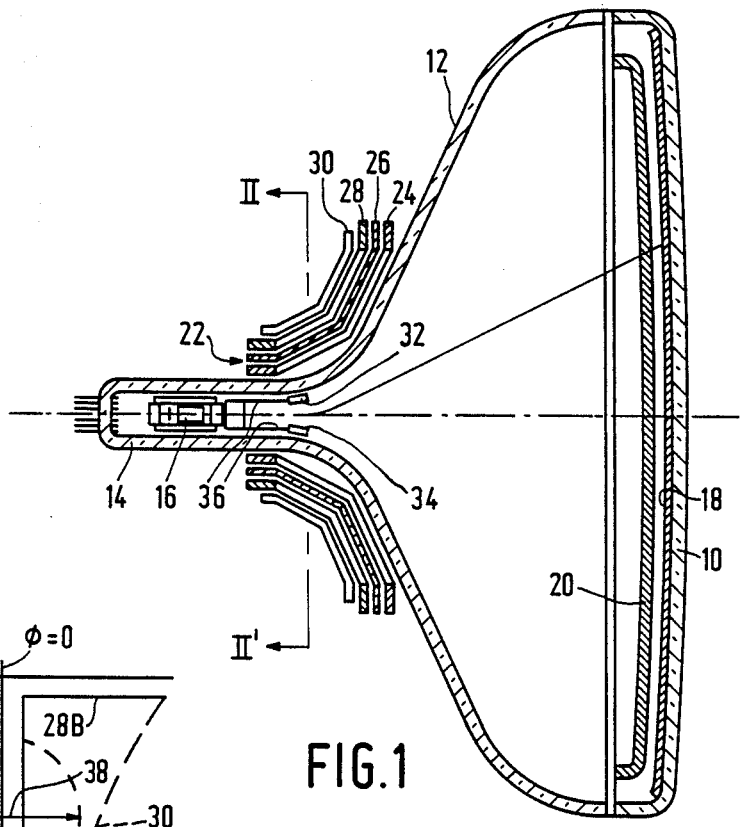
FIG. 1 is a vertical cross-sectional view through a colour cathode ray tube made in accordance with the present invention.

FIG. 1 illustrates a shadow mask color cathode ray tube comprising an envelope formed by an optically transparent faceplate 10, a cone 12 and a neck 14. An in-line, triple electron beam gun structure 16 is disposed in the neck 14. A cathodoluminescent screen 18 comprising triplets of phosphor elements is provided on the inside of the faceplate 10. The triplets of phosphor elements can have a striped structure which is generally used in television tubes or a hexagonal structure as used in some datagraphic display tubes. A shadow mask 20 is mounted inside the faceplate 10 adjacent to, but spaced from, the screen 18.

Figure 2:
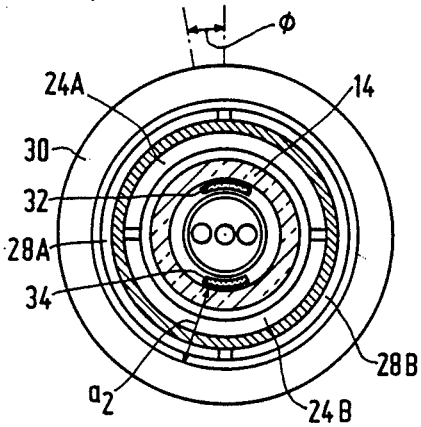
FIG. 2 is a cross-sectional view on the line II—II' of FIG. 1.

A deflection unit 22 is mounted externally of the envelope at the neck-cone transition. In the embodiment illustrated the unit 22 comprises a line deflection coil 24 comprising two saddle type coil portions 24A, 24B (FIG. 2) arranged on opposite sides of the plane containing the electron beams. The coil portions 24A, 24B are fitted inside a resin shell 26 on the external surface of which is mounted the field deflection coil 28. The coil 28 comprises two saddle type coil portions 28A, 28B arranged orthogonally to the coil portions 24A, 24B. A yoke ring 30 is arranged about the coil portions 28A, 28B.

In an alternative non-illustrated embodiment the field deflection coil 28 comprises toroidal windings on the yoke ring 30, which windings lie transverse heightwise of the plane containing the electron beams.

A pair of oppositely disposed magnetic field conducting elements consisting of plates 32, 34 are mounted within the envelope, more particularly the neck 14, so as to be within the deflection field produced by the field coil 28. The plates 32, 34 are of a soft magnetic material having a permeability greater than 100 and of generally rectangular shape. These plates 32, 34 are separated heightwise on opposite sides of the plane of the electron beams. They can be mounted by means of arms 36 of a non-magnetic material which are secured to the centering cup of the electron gun structure 16 or alternatively they may be held captive against the internal surface of envelope.

The axial position of the plates 32, 34 relative to the deflection field produced by the field coil 28 has to be determined taking into account a number of factors. These factors include that a deflection field should be present. The plates 32, 34, which serve to improve the sensitivity and field astigmatism by rendering the deflection field barrelshaped at the central deflection area, should not influence coma and raster more than necessary. The plates 32, 34 should be located in the unused space within the neck 14 which unused space terminates at the forward end when the plates 32, 34 interfere physically with the paths of the electron beams.

Figure 4:
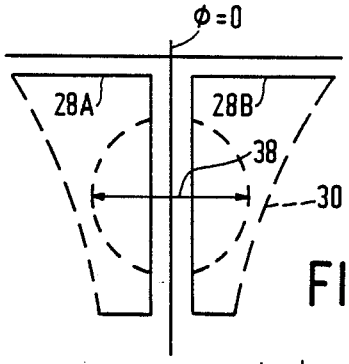
FIG. 4 is a diagram illustrating the central deflection area in the magnetic field produced by the field coil.

FIG. 4 illustrates diagrammatically the field coil portions 28A, 28B and the yoke ring 30. The central deflection area 38 is indicated by the broken lines and it is the field in this area which it is desired to be rendered barrel shaped.

In the case of a toroidally wound field coil, the magnetic field it produces extends rearward beyond the end of the coil and in consequence the central deflection area, is located further back, relative to the screen, than with a saddle-type field coil.

Figure 3:
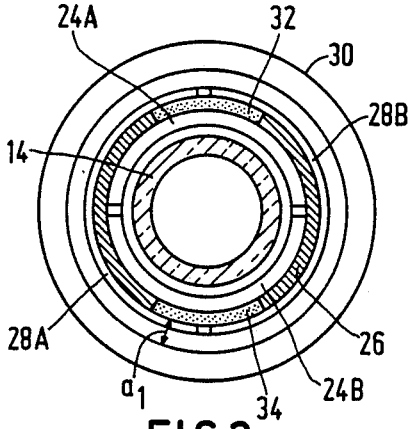
FIG.3 PRIOR ART
FIG. 3 is a cross-sectional view of a prior art color cathode ray tube and deflection unit.

By way of comparison FIG. 3 is a cross-sectional view of the deflection unit disclosed in U.S. Pat. No. 4,242,612. For ease of comparison the same reference numerals have been used to indicate corresponding parts in FIGS. 2 and 3.

Disposing the plates 32, 34 inside the envelope (FIG. 2) provides an improved sensitivity compared to disposing them between the line and field coils 24, 28, respectively (FIG. 3). In FIG. 3 the plates 32, 34 are very close to the copper wire of the field coil 28 and only a short distance, $a_1$, from the yoke ring 30. This arrangement gives rise to unnecessary flux which affects adversely the sensitivity of the field coil. By way of comparison, in FIG. 2 the plates are further from the copper wire of the field coil 28 and at a distance, $a_2$, from the yoke ring 30. By the distance $a_2$ being greater than the distance $a_1$ there is less unnecessary flux and hence a better picture sensitivity.

What is claimed is:

1. A color cathode ray tube comprising:

an envelope including, in sequence, a faceplate, a cone, and a neck, said faceplate having a cathodoluminescent screen thereon, said envelope having a longitudinal axis centrally disposed in said neck and substantially perpendicular to said faceplate, and said cone and neck being joined at a neck-cone transition portion of the envelope, a shadow mask adjacent to but spaced from the faceplate, an in-line electron beam producing means disposed within the neck for producing three electron beams which lie, when undeflected, substantially in a single plane on which the longitudinal axis lies, the axis of the central of said beams, when undeflected, substantially coinciding with said longitudinal axis, a deflection unit arranged on the neck-cone transition portion of the envelope and comprising a field deflection coil defining a central deflection area within the transition portion and a line deflection coil, magnetic field conducting means disposed within the neck-cone transition portion of the envelope and arranged on opposite sides of said plane such that, when the field deflection coil is energized, the deflection field produced at the central deflection area is barrel shaped.

2. A color cathode ray tube as claimed in claim 1, characterized in that said magnetic field conducting means is disposed adjacent to the central deflection area.

3. A color cathode ray tube as claimed in claim 1, characterized in that said magnetic field conducting means comprise a pair of oppositely disposed magnetic field conducting elements, separated heightwise on opposite sides of the plane of the electron beams.

4. A color cathode ray tube as claimed in claim 1, characterized in that said magnetic field conducting elements comprise plates of a soft magnetic material.

5. A color cathode ray tube as claimed in claim 1, characterized in that said magnetic field conducting means are affixed to the internal surface of the envelope.

6. A color cathode ray tube as claimed in claim 1, characterized in that said magnetic field conducting means are carried by the in-line electron beam producing means.

7. A color cathode ray tube as claimed in claim 1, characterized in that said field conducting elements are secured to a non-magnetic field conducting member secured to the in-line electron beam producing means.

* * * * *